United States Patent [19]

Vallée

[11] 4,090,435

[45] May 23, 1978

[54] VENTILATORS

[76] Inventor: Louis Léonce Vallée, 6392 Maubourg Ave., Montreal, Quebec, Canada, H1M 2C8

[21] Appl. No.: 769,884

[22] Filed: Feb. 18, 1977

[30] Foreign Application Priority Data
Mar. 18, 1976 Canada ..... 248407

[51] Int. Cl.[2] ..... F24F 7/02

[52] U.S. Cl. ..... 98/42 A; 98/42 R; 52/199

[58] Field of Search ..... 98/42.1, 42 A, 42 R, 98/32, 37, 114, DIG. 6; 52/198, 199

[56] References Cited

U.S. PATENT DOCUMENTS

| | | | |
|---|---|---|---|
| 2,214,183 | 9/1940 | Seymour | 98/42 A |
| 2,579,662 | 12/1951 | Gibson | 98/42 A |
| 2,625,094 | 1/1953 | Bonforte | 98/42 A |
| 2,704,500 | 3/1955 | Bonforte | 98/42 A |
| 3,079,853 | 3/1963 | Smith | 98/42 A |
| 3,185,070 | 5/1965 | Smith | 98/42 A |

*Primary Examiner*—John J. Camby
*Assistant Examiner*—Henry C. Yuen
*Attorney, Agent, or Firm*—Larson, Taylor & Hinds

[57] ABSTRACT

A ventilator for use with sheet metal roofing either of the batten type using elongated pan sections or flat sheets.

In a preferred form of the invention using sheet metal pan sections between battens, the pan sections are lap-joined at the ridge of the roof and a ventilator opening is cut in the overlapped end portions of the pan sections and in the underlying roof on either side of the ridge of the roof. The base member of the ventilator is formed from a single sheet of metal and has a central opening coinciding with the opening in the pan section. The edge portions of the central opening in the base member of the ventilator are upturned to form side walls defining the ventilator opening and a screen is fitted into the opening. Downwards of the ventilator opening, on each side of the ridge of the roof, the lower edge portions of the base member are folded back on themselves in curved form to form wind breakers extending between battens of the pan sections. A cover member for the ventilator is secured to the top surface of the battens on either side of the ventilator and the lowermost edges of the cover are bent downwards and backward on themselves to form troughs between battens and combine with the wind breakers to form offset air passages between the interior of the ventilator and the exterior of the roof, with the wind breakers having a suction effect to draw air outwards from the interior of the roof.

8 Claims, 9 Drawing Figures

VENTILATORS

This invention relates to ventilators for the roof of buildings and particularly for buildings having sheet metal roof covering.

The invention is particularly applicable for use with batten type roof coverings of the type disclosed in my copending Canadian Patent Application Ser. No. 233,923, filed Aug. 21, 1975, wherein the batten structure is built into the sheet metal roof covering.

In batten type roof coverings where the battens extend to the ridge of the roof, it has been difficult to provide a satisfactory ventilator between battens at the ridge of the roof and to make such ventilators completely weatherproof.

In the present invention, advantage is taken of the roofing structure disclosed in my above-mentioned patent application to design a ventilator having structure which will readily fit in with the disclosed roofing structure to make the ventilator highly efficient and fully weatherproof.

A portion of the pan sections between battens are cut out to form a rectangular opening over a similar opening in the underlying roof structure and straddling the ridge of the roof. The base member of the ventilator is formed of a sheet of metal and extends between a pair of battens. The base member has a central opening coinciding with the central opening in the underlying pan section and roof structure, and has its peripheral edge portions upturned to form vertical side walls around the opening. A screen is fitted into the opening in known manner. The lower edge portions of the base member of the ventilator on either side of the ridge of the roof are folded upwards and backwards in curved form to form wind breakers and extend transversely between adjacent pairs of battens. A ridge cover member is fitted over the adjacent batten structures and extends downwards on either side of the roof ridge to beyond the wind breakers formed on the ventilator base member and has its lower edges down turned to provide an offset air passage between the lower portions of the cover and the wind breakers.

A primary object of the invention is to provide a ventilator for use in conjunction with a sheet metal roof of the batten type in which adjacent battens form a part of the ventilator and add to the protection of the ventilator against mechanical and wind force damage.

A further object of the invention is to provide a ventilator for installation at the ridge of a building roof which has a base structure secured on the pans of a sheet metal batten type roof.

A still further object of the invention is to provide a ventilator for installation at the ridge of a sheet metal batten type roof in which a ridge cap for the ventilator is secured to adjacent battens of the roofing over the ventilator openings and extends downwards on either side of the roof ridge.

A further object of the invention is to provide, in the ventilator, a wind breaker located downwards of the ventilator combining with a formed lower edge portion of the ridge cap to produce a suction effect withdrawing air from the interior of the building.

These and other objects of the invention will be apparent from the following specification and the attached drawings in which.

Figure 1:
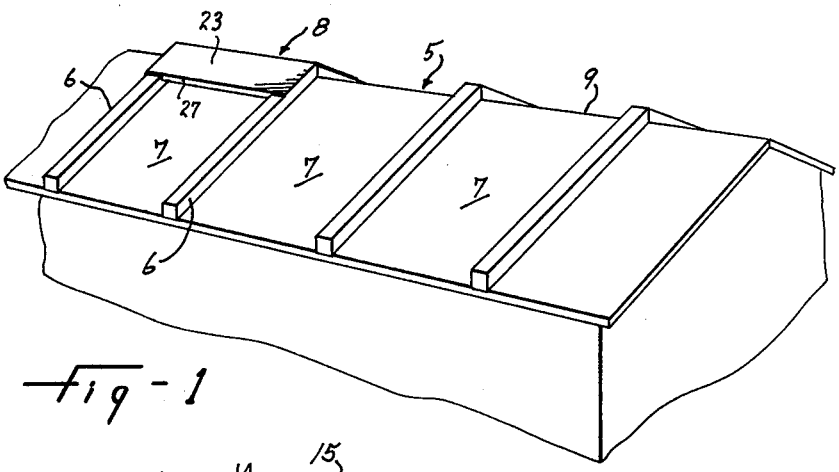
FIG. 1 is a perspective drawing of a batten type sheet metal roof showing a ventilator at the ridge of the roof according to the present invention.

Referring to the drawings, FIG. 1 shows a perspective view of a sheet metal roof 5 of the batten type in which the battens are indicated by the numeral 6, and the pan sections of the metal roof are indicated by the numeral 7.

One ventilator 8 is shown in FIG. 1. However, it is understood that more than one ventilator may be installed on the roof in the manner shown or a number of ventilators can be installed between battens 7 and a common cover be fitted over all of the ventilators at the roof ridge 9.

Figure 2:
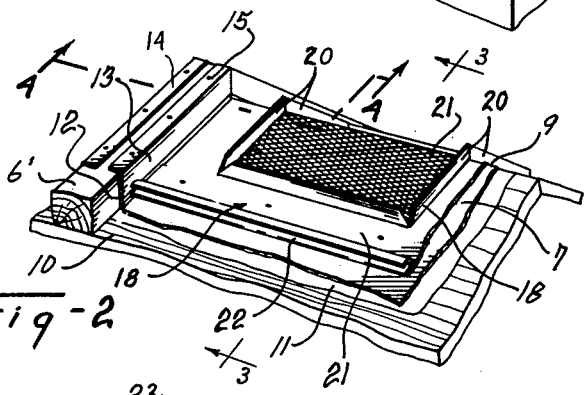
FIG. 2 is an enlarged perspective view of the ventilator shown in FIG. 1 with the ventilator ridge cap removed.
Figure 3:
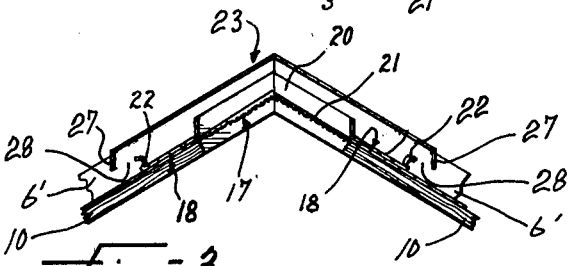
FIG. 3 is a transverse section of the ventilator taken on the line 3—3 of FIG. 2.
Figure 4:
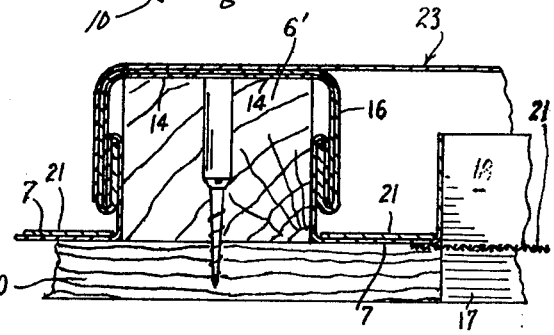
FIG. 4 is an enlarged partial sectional detail taken on the line 4—4 of FIG. 2, showing the ventilator opening and cover with one form of pan section.
Figure 6:
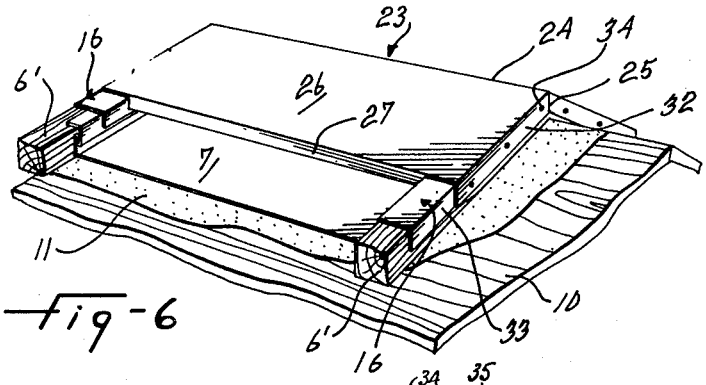
FIG. 6 is a view of the ventilator similar to FIG. 2 with the ridge cap in place.

Referring now more particularly to FIGS. 2 and 3 of the drawings, the roof is shown as having wood battens 6' secured to the underlying roof 10 which is covered with tar paper 11. The pan sections 7 of the sheet metal roofing extend upwards to the ridge of the roof and have their upper edge overlapped at the ridge of the roof to make a weatherproof seal. These pan sections 7 of the roofing have their side edges 12 folded at 13 and bent over the top surface of the battens 6' at 14 and are secured thereto by the screws 15. A top cover 16 for the battens 6' engages with the side folds 13 of the pan sections 7 to provide weathertight protection for the joint between adjacent pan sections, as shown in FIG. 4.

The pan sections 7 of the sheet metal roofing and the underlying roof 10 are cut out on both sides of the roof ridge 9, as indicated at 17.

The base member 18 of the ventilator is formed from a sheet of metal having a width to fit between the side edges 12 of the batten structure and overlies the pan section 7 on either side of the ridge of the roof. The base member 18 has a central cut-out 19 which is smaller than the cut-out 17 in the underlying pan section and roof structure and has its peripheral edge portions bent upwards to form vertical side walls 20. The side walls 20 are approximately half the height of the battens 6' to permit the flow of air around the side walls 20. A screen 21 is fitted within the cut-out to prevent the passage through the ventilator of material other than air.

The lower edge portions of the base member 18 are folded upwards and outwards in curved form to form wind breakers 22 extending longitudinally between the side folds 13 of the pan sections. The height of the wind breakers 22 above the surface of the pan section 7 is less than the height of the top surface of the adjacent battens 6'.

The ventilator cover 23 is of sheet metal and is creased and bent along the center line 24 between the notches 25 to conform, when bent, with the angle of the roof. The surfaces 26 of the cover 23 extend downwards from the line 24 to beyond the wind breakers 22 and their lower edges are bent downwards at 27 to form a baffle and to define a shallow opening to the air passage 28 between their lower edge and the top surface of the pan sections 7 below the portion 22 of the wind breakers 20. The corners of the cover 23 are notched at 30 and the side edges are bent downwards along the lines 31 to form flanges 32. These flanges 32 lie snugly against the outer side wall 33 of the batten cover 16 and the cover 23 is secured to the battens 6' by the screws 34.

Figure 7:
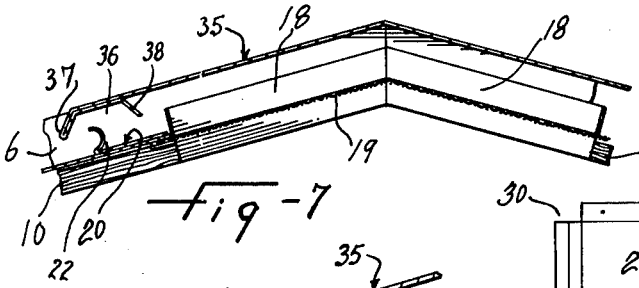
FIG. 7 is an enlarged partial transverse section similar to FIG. 3, but showing a modified form of ridge cap having a trough combining with the wind breaker to form an offset air flow passage.
Figure 8:
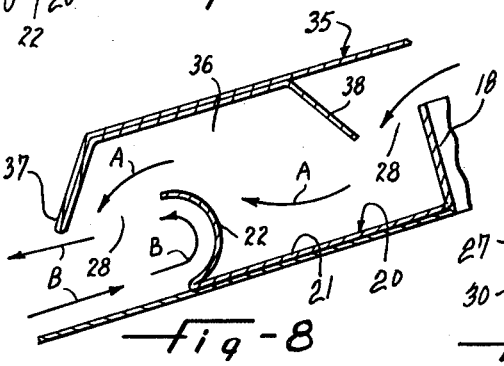
FIG. 8 is an enlarged detail of the offset air passage shown in FIG. 7 with arrows depicting the suction effect of the combined air breaker and trough in the ridge cap inducing an outward flow of air from the interior of the building.
Figure 9:
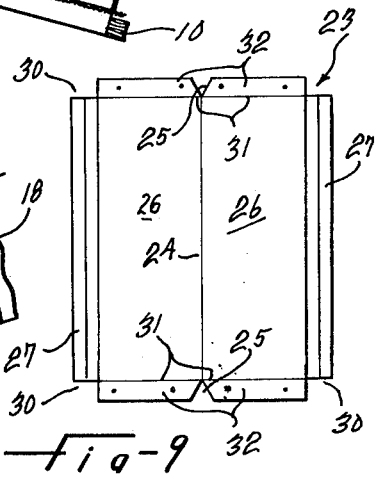
FIG. 9 is an expanded view of the ventilator ridge cap.

In FIGS. 7 and 8, there is shown a modified form of ventilator cover 35 in which the lower end portions are folded back on themselves to form an inverted trough 36 whose lower side wall 37 defines with the wind breaker 22 the outer portion of the air passage 28, while the other side wall 38 of the trough 36 defines with the adjacent side wall 18 an inner portion of the air passage 28.

The flow of air from the inside of the house to the outside is indicated by the arrow A in FIG. 8, while outside air attempting to enter the house through the ventilator is deflected by the curved portion of the wind breaker 22, as indicated by the arrows B.

All screws 34 and exposed edges of the cover 23 are sealed by a mastic compound.

Figure 5:
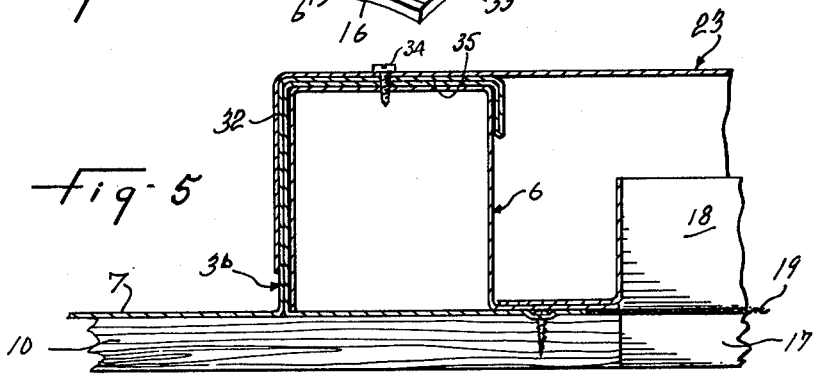
FIG. 5 is a view similar to FIG. 4, but showing a modified form of pan section and batten structure.

In one form of sheet metal roofing of the batten type, the battens are structurally formed as a unitary part of the pan sections making up the sheet metal roof as shown in FIG. 5 and as disclosed in my copending Canadian Patent Application No. 233,923, filed Aug. 21, 1975.

The ventilator for use with the particular batten structure disclosed in the above-mentioned Patent Application No. 233,923 is exactly as detailed above with the exception that the edges of adjacent pan sections are interlocked to form the battens of the roofing. The wood battens 6' and the batten covers 16 are eliminated and the ventilator cover 23 is secured to the top surface 39 of the structural battens, as shown in FIG. 5.

In the operation of this invention, as illustrated in FIGS. 1 to 9, the ventilator 8 has a low profile formed on the pan sections 7 of the sheet metal roof between the battens 6 of the roofing and, combined with the battens and the sheet metal cover 23 or 35 secured to the top surface of the battens, presents a minimum of structure on the roof which would be affected by mechanical or high wind forces. The relatively shallow openings to the air passage 28, combined with the wind breakers 22, ensure that any wind blast will be broken and have little or no effect on the natural operation of the ventilator in permitting the entry or exit of air through the ventilator opening 17 on one side or other of the roof, depending on the direction of wind flow outside the building.

With the ventilator being preformed with the pan sections of the roofing, the roofing can be installed with a minimum of time and labour and the only additional work required is the installation of the ventilator cover 23 to the top surface of the battens.

One or any number of the pan sections 7 on both sides of the roof can be fitted with a ventilator and where adjacent pan sections are fitted with a ventilator, the ventilator cover can be formed in one piece to extend over intervening battens and be secured to all of the battens to give a smooth appearance to the ridge of the roof.

The embodiments of the invention in which an exclusive property or privilege is claimed are defined as follows:

1. A roof ridge ventilator for sheet metal roofing wherein the sheet metal roofing has a cut out ventilator opening and a screen is fitted into the ventilator opening, the said ventilator having a pair of opposing side walls spaced outwardly of adjacent side edges of the cut out ventilator opening in the roof, a pair of wind breakers spaced downwardly of the adjacent end edges of the cut out ventilator opening in the roof and extending between the opposing side walls of the ventilator, and a cover member secured to the said opposing side walls of the ventilator and extending downwardly beyond the said wind breakers, the downward edges of the said cover member adjacent to the said wind breakers being bent downwardly and outwardly to define with the said wind breakers openings to the interior of the ventilator.

2. A roof ridge ventilator as set forth in claim 1 in which the sheet metal roofing is of the batten type formed of pan sections whose upper edges are overlapped at the roof ridge and whose longitudinal edges define roof battens, and the ventilator opening straddles the ridge of the roof in the area between the roof battens.

3. A roof ridge ventilator as set forth in claim 2 in which the peripheral edges of the ventilator opening are upturned to form side walls defining the ventilator opening.

4. A roof ridge ventilator as set forth in claim 3 in which the side walls defining the ventilator opening extend upwards to about half the height of the adjacent battens and the said side walls are parallel with the adjacent battens and in spaced relation thereto.

5. A roof ridge ventilator as set forth in claim 2 in which the cover member is formed of sheet metal having parallel side edges notched and folded between notches to conform to the angle of the roof on eigher side of the ridge of the roof, and having their opposite end edges folded over to engage with the top surface and outer facing sides of the said adjacent battens of the roof.

6. A roof ridge ventilator as set forth in claim 5 in which the opposite edge portions of the said cover member parallel with the fold line are bent downwards to form a baffle extending between the said adjacent battens.

7. A roof ridge ventilator as set forth in claim 6 in which the baffle edge portions of the cover member are spaced downwardly in spaced relation to the upwardly and outwardly curved edge portions of the said wind breakers.

8. A roof ridge ventilator as set forth in claim 7 in which the upwardly and outwardly curved edge portion of the wind breakers and the downwardly bent baffle edge portions of the cover member combine to define offset passages to the interior of the ventilator on either side of the ridge of the roof between battens.

* * * * *